US011701571B2

(12) United States Patent
Indulti et al.

(10) Patent No.: US 11,701,571 B2
(45) Date of Patent: Jul. 18, 2023

(54) REAR PORTION OF A SKI MOUNTAINEERING BINDING

(71) Applicant: ATK SPORTS S.r.l., Fiorano Modenese (IT)

(72) Inventors: Giovanni Indulti, Fiorano Modenese (IT); Davide Indulti, Fiorano Modenese (IT)

(73) Assignee: ATK SPORTS S.R.L., Fiorano Modenese (IT)

( * ) Notice: Subject to any disclaimer, the term of this patent is extended or adjusted under 35 U.S.C. 154(b) by 0 days.

(21) Appl. No.: 17/740,749

(22) Filed: May 10, 2022

(65) Prior Publication Data

US 2022/0370886 A1 Nov. 24, 2022

(30) Foreign Application Priority Data

May 19, 2021 (IT) ..... 102021000012872

(51) Int. Cl.
*A63C 7/10* (2006.01)

(52) U.S. Cl.
CPC ..... *A63C 7/1026* (2013.01); *A63C 7/108* (2013.01); *A63C 7/1093* (2013.01)

(58) Field of Classification Search
CPC ..... A63C 7/1026; A63C 7/108; A63C 7/1093; A63C 2009/008; A63C 7/104; A63C 9/001; A63C 9/006; A63C 9/0807; A63C 9/0845; A63C 9/086
See application file for complete search history.

(56) References Cited

U.S. PATENT DOCUMENTS 4,230,337 A * 10/1980 Storandt ..... A63C 7/102 280/605
6,073,955 A * 6/2000 Chonier ..... A63C 7/1093 280/634
8,919,805 B2 * 12/2014 Giordani ..... A63C 9/086 280/623

(Continued)

FOREIGN PATENT DOCUMENTS

DE 202016004170 U1 * 9/2016
EP 2762211 A2 * 8/2014 ..... A63C 9/0807

(Continued)

*Primary Examiner* — James A Shriver, II
*Assistant Examiner* — Michael T. Walsh
(74) *Attorney, Agent, or Firm* — R. Neil Sudol; Henry D. Coleman

(57) ABSTRACT

A rear portion of a ski mountaineering binding includes a base, a turret rotatable with respect to the base, a brake fixable to the ski for braking the ski, first elastic element arranged to exert a force to bring the brake into a braking configuration, and a hooking member borne by the base and having a hook for hooking the brake. The hooking member has engaged and disengaged configurations. A second elastic element pushes the hooking member into the engaged configuration. A cam borne by the turret has a pusher borne by the base, activatable by the cam and movable along a second movement path. The hooking member includes an abutment for abutting the pusher and is activatable by the turret via the cam and the pusher, to assume the disengaged configuration and alternately the engaged configuration.

11 Claims, 9 Drawing Sheets

(56) References Cited

U.S. PATENT DOCUMENTS

| | | | | |
|---|---|---|---|---|
| 9,022,410 | B2 * | 5/2015 | Giordani | A63C 9/0845<br>280/617 |
| 10,010,782 | B2 * | 7/2018 | Damiani | A63C 9/0807 |
| 10,569,155 | B2 * | 2/2020 | Pantazelos | A63C 9/0802 |
| 2015/0014963 | A1 * | 1/2015 | Shute | A63C 9/0845<br>280/614 |
| 2022/0219069 | A1 * | 7/2022 | Eckart | A63C 7/1026 |

FOREIGN PATENT DOCUMENTS

| | | | | |
|---|---|---|---|---|
| EP | 3560563 | | 10/2019 | |
| EP | 3560563 | A1 * | 10/2019 | A63C 7/1026 |
| WO | WO-2007010392 | A2 * | 1/2007 | A63C 9/02 |

* cited by examiner

REAR PORTION OF A SKI MOUNTAINEERING BINDING

BACKGROUND OF THE INVENTION

The present invention relates to the technical sector concerning a ski mountaineering binding, with particular reference to a rear portion of the ski binding provided with a brake for a ski.

A rear portion of a ski mountaineering binding is known from EP3560563, which:

is fixable to a ski;

comprises a base in order to be fixed to a ski;

comprises a turret which is borne by the base and which is rotatable with respect to the base in order to assume a first position of the turret, in which it is hookable to the heel of a ski boot for skiing downhill, and in order to assume a second position of the turret, in which it is not hookable to the heel of a ski boot, so that it is possible to walk uphill;

comprises a brake for a ski which is fixable to the ski and which can assume a braked configuration, in which it brakes the ski, and a non-active configuration in which the brake is non-active;

comprises first elastic means which are arranged so as to exert a force which tends to bring the brake into braked configuration;

comprises a hooking member which: is borne by the base; comprises a hook for hooking the brake; is movable along a first movement path which is perpendicular to the axis of the ski between a disengaged configuration, in which the hook is moved away and not able to hook the brake, and an engaged configuration, in which the hook can hook the brake when the brake is brought into the non-active configuration; is manually activatable by means of a relative end;

comprises second elastic means acting on the hooking member, in order to exert a force which tends to push the hooking member into the disengaged configuration, in opposition with the force manually exertable by the user on the end of the hooking member.

Further, the brake comprises an activating lever which is arranged so as to be pressed by a heel of a ski boot when the heel of the ski boot hooks the turret in the first position of the turret, for skiing downhill. The brake is also designed in such a way that the pressure of the activating lever by the heel of the ski boot shifts the brake to assume the non-active configuration, against the action of the first elastic means.

A description of the functioning follows. First consider the turret in the first position of the turret, the hooking member in the disengaged configuration and the brake is in the braked configuration. In order to ski downhill, all that is needed is to hook the heel of the ski boot with the turret, which brings the brake into the non-active configuration.

Then, in order to be able to ski uphill the heel of the ski boot is unhooked from the turret and the turret can be rotated to assume the second position of the turret; further, the user must, in a sequence: press the end of the hooking member bringing the hooking member into the engaged configuration; bring the brake into the non-active configuration (for example by pressing on the activating lever); and release the end of the hooking member so that the second elastic means cause the hooking of the hook of the hooking member with the brake, which, consequently, remains stably blocked in the non-active configuration.

To return to downhill skiing, it is enough to press the end of the hooking member against the action of the second elastic means, until realising the unhooking of the brake which, via the first elastic means, moves into the braked configuration.

SUMMARY OF THE INVENTION

The aim of the invention consists in simplifying the operations that the user must carry out in order to ski either downhill or uphill.

To predispose the rear portion of a ski binding pursuant to the present invention for a descent, after having walked uphill, the user has only to rotate the turret to bring it into the first position of the turret.

To predispose the rear portion of the ski binding for an ascent, after having skied downhill, the user must rotate the turret, in order to bring it into the second position of the turret, and must only additionally bring the brake into the non-active configuration, so that it stably hooks to the hooking member.

This advantageously simplifies the operations that the user must carry out in order to ski either downhill or uphill.

A further advantage consists in the possibility of modifying the shape, the length and orientation of the pusher in order to achieve greater flexibility during the design step. Consequently, the rear portion of ski mountaineering binding can be designed so as to have optimal distribution of the weight along the axis of the ski and/or to maximise the reliability and experience in use.

BRIEF DESCRIPTION OF THE DRAWINGS

Specific embodiments of the invention will be described in the following part of the present description, according to what is included in the claims and with the aid of the appended tables of drawings, in which:

DETAILED DESCRIPTION

Figure 1:
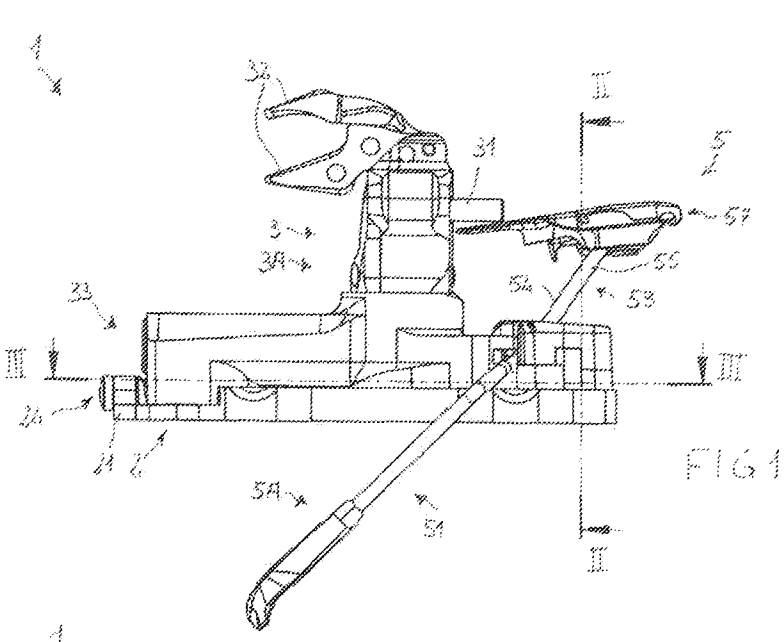
FIG. 1 is a lateral view of the rear portion of the ski mountaineering binding according to a first embodiment of the invention, in a configuration in which the relative turret is in a first position of the turret for skiing downhill and the brake is in the braked configuration.
Figure 2:
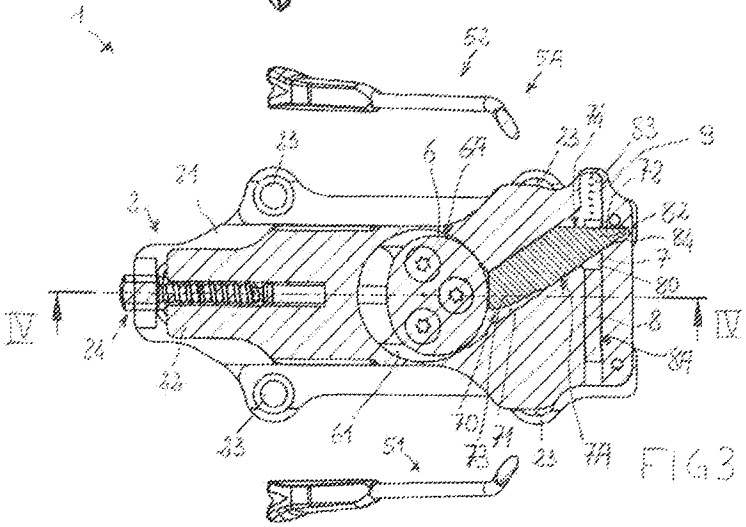
FIG. 2 is a section view, along line II-II of FIG. 1.
Figure 3:
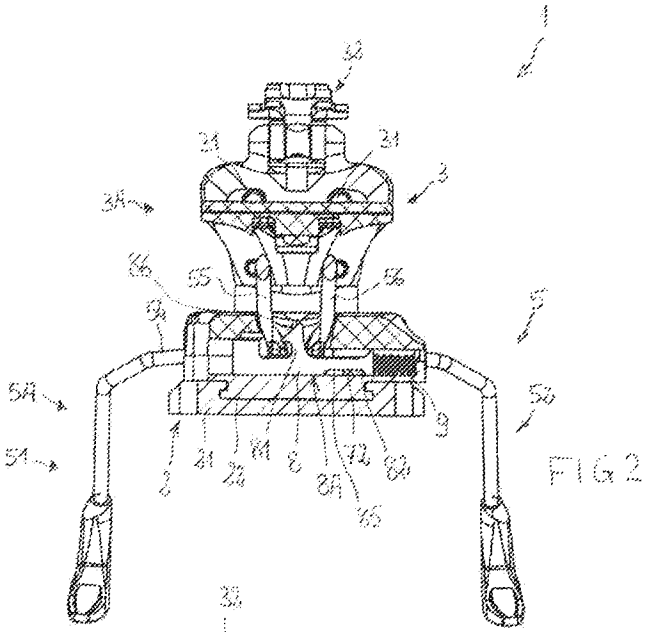
FIG. 3 is a section view, along line III-III of FIG. 1.
Figure 4:
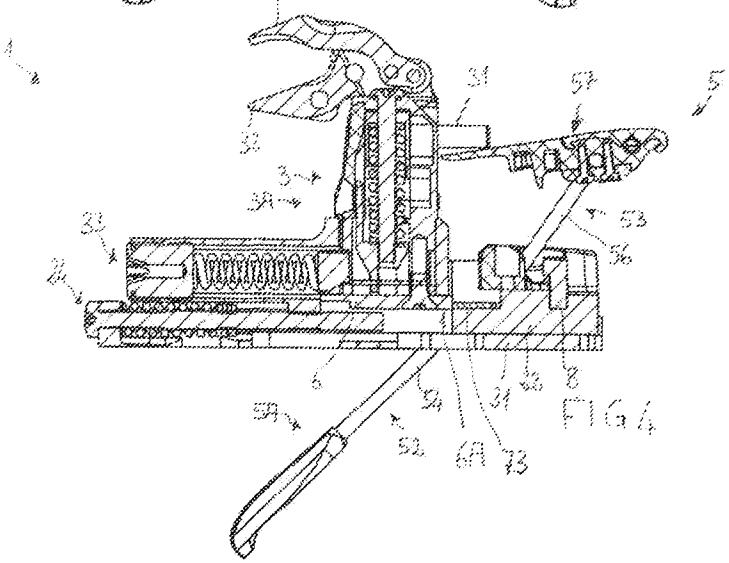
FIG. 4 is a view according to section plane IV-IV of FIG. 3.
Figure 5:
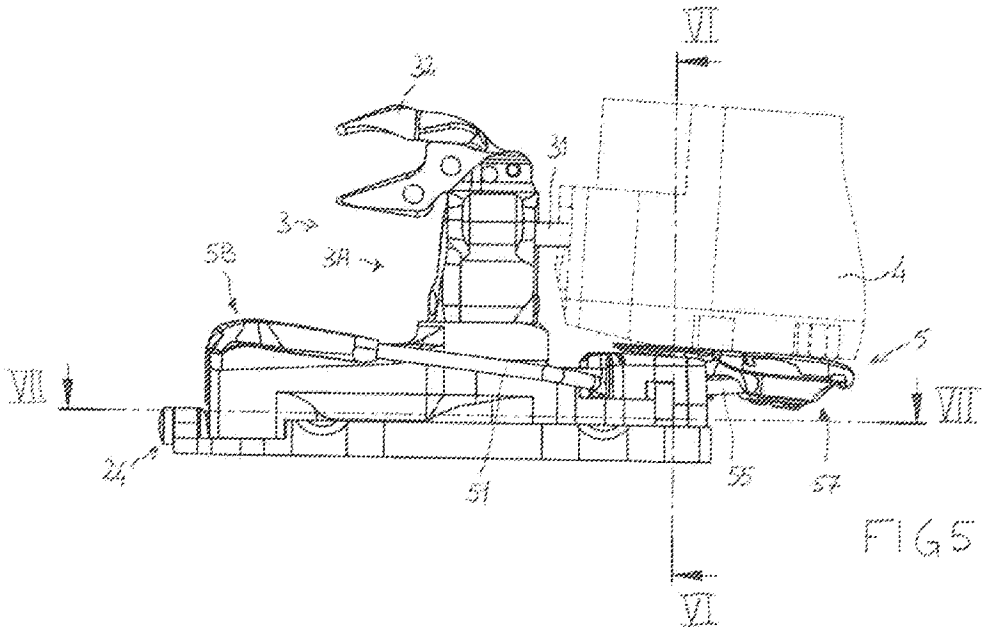
FIG. 5 is a lateral view of the rear portion of ski mountaineering binding of FIG. 1 and of a heel of a ski boot coupled to the turret, in a configuration successive to the one shown in FIG. 1, in which the turret is in the first position of the turret and the brake has reached a non-active configuration after the heel of the ski boot has been hooked to the turret; the user can then ski downhill.
Figure 7:
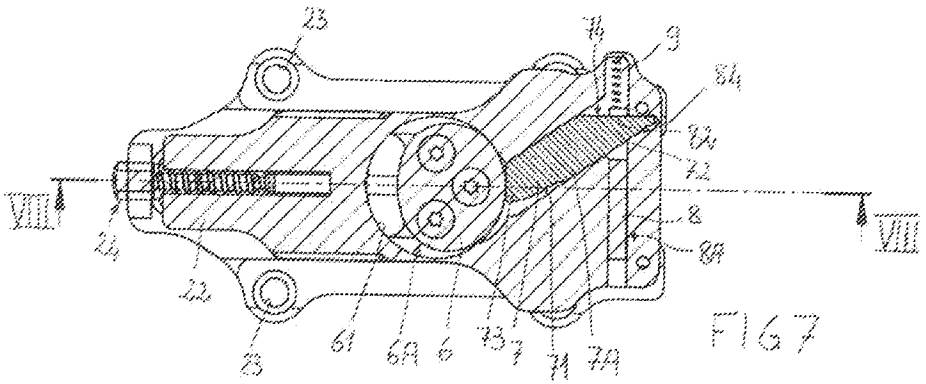
FIG. 7 is a view according to section plane VII-VII of FIG. 5.
Figure 6:
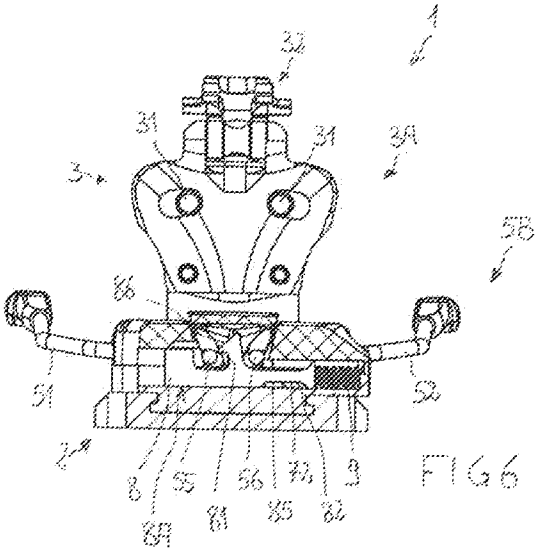
FIG. 6 is a section view, along line VI-VI, of FIG. 5, in which the heel of the ski boot has not been illustrated in order to better evidence other details.
Figure 8:
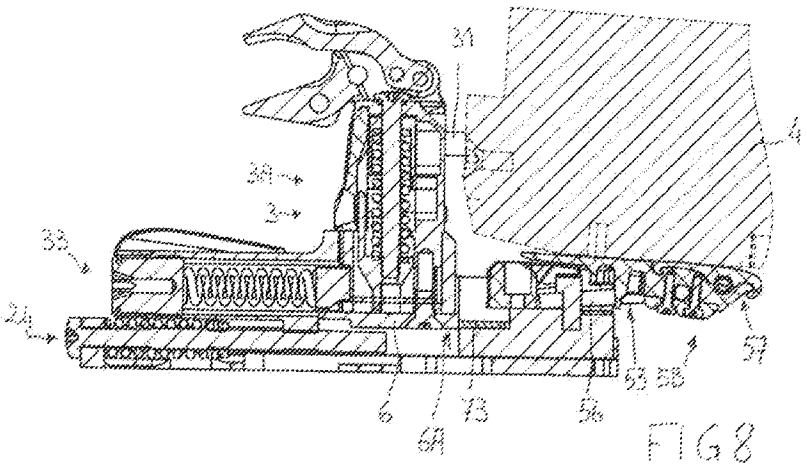
FIG. 8 is a view according to section plane VIII-VIII of FIG. 7, in which the heel of the ski boot has not been illustrated.
Figure 9:
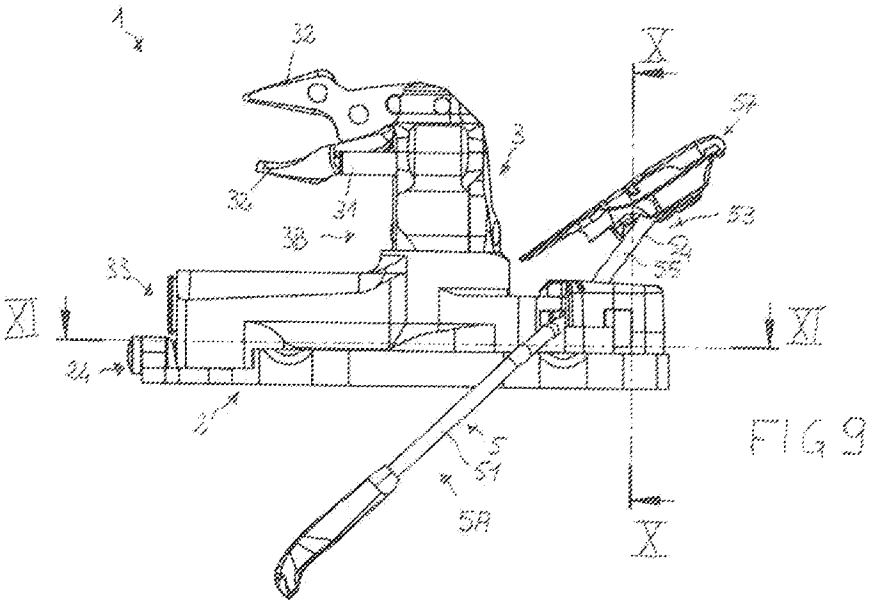
FIG. 9 is a lateral view of the rear portion of the ski mountaineering binding of FIG. 1, in a configuration successive to the one shown in FIG. 1, in which the turret has reached a second position of the turret so as to enable walking uphill is in the braked configuration.
Figure 11:
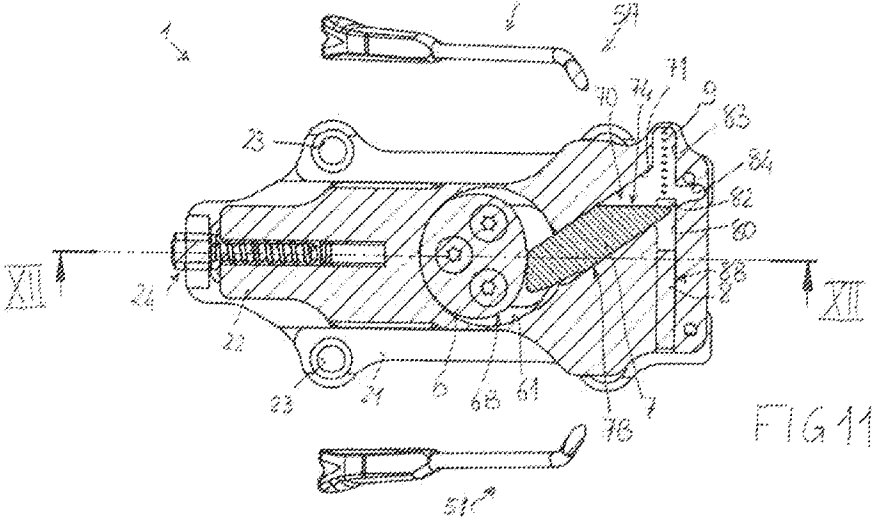
FIG. 11 is a view according to section plane XI-XI of FIG. 9.
Figure 10:
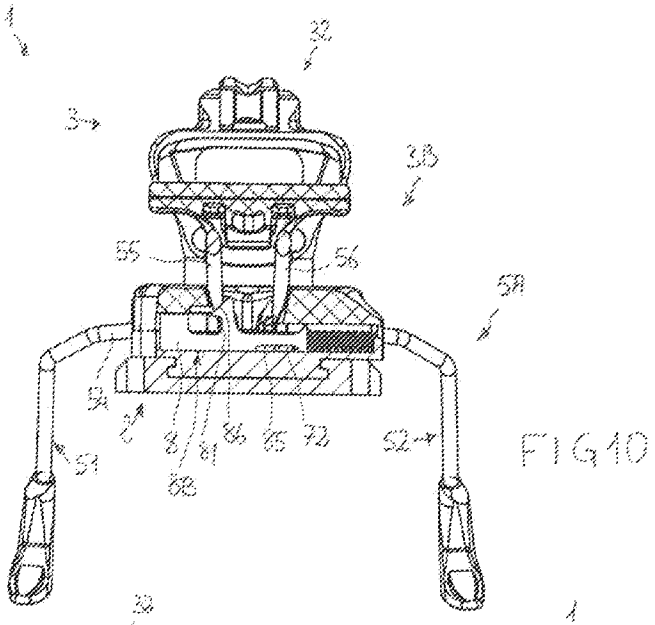
FIG. 10 is a view according to section plane X-X of FIG. 9.
Figure 12:
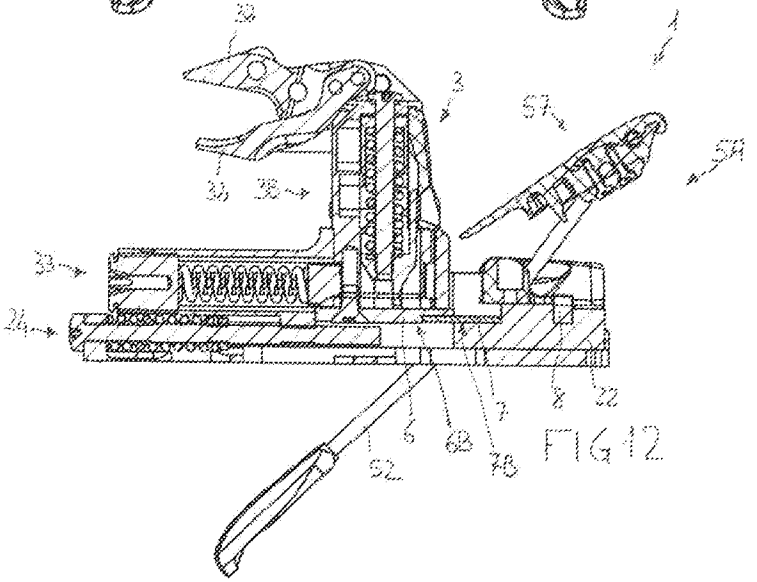
FIG. 12 is a view according to section plane XII-XII of FIG. 11.
Figure 13:
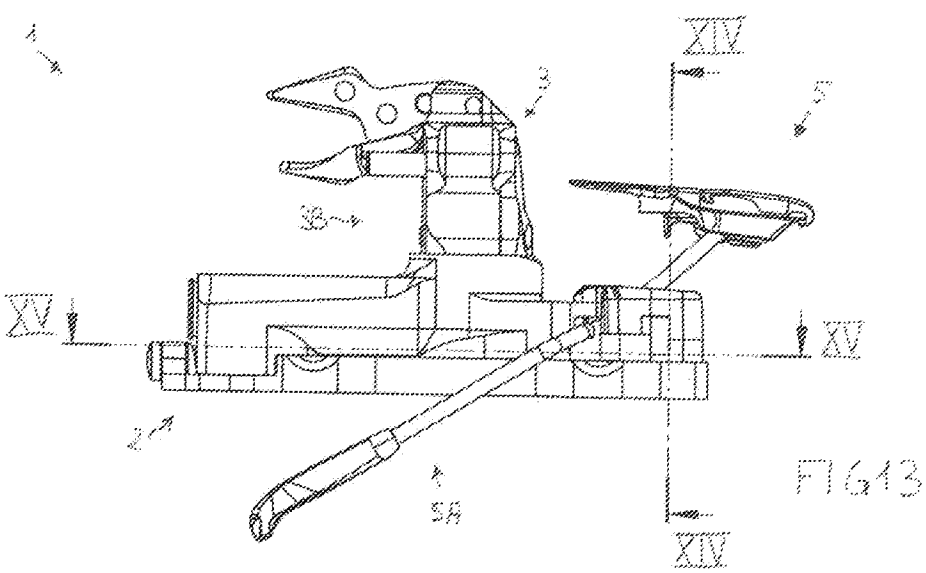
FIG. 13 is a lateral view of the rear portion of the ski mountaineering binding of FIG. 1, in a configuration successive to the one shown in FIG. 9, in which the turret is in the second position of the turret for walking uphill and the brake is moving towards the non-active configuration, but is still near the braked configuration.
Figure 15:
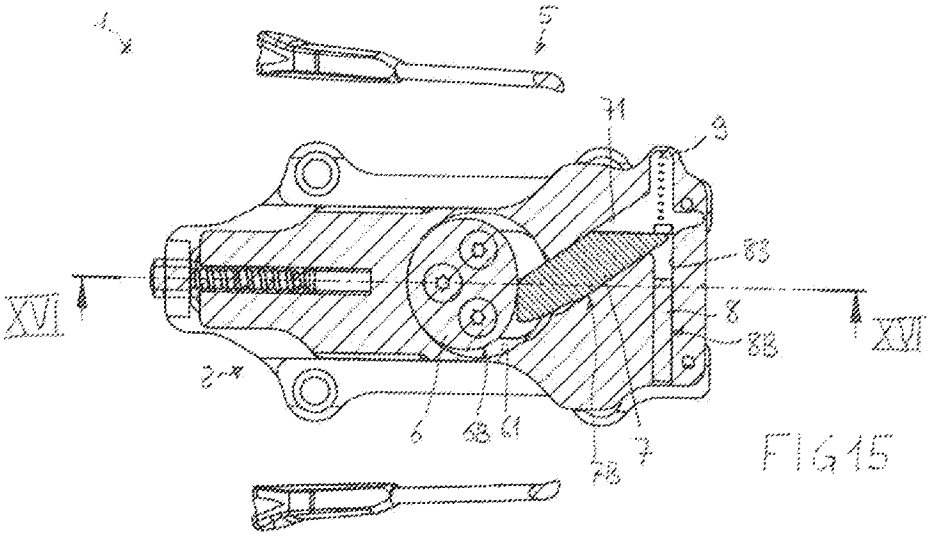
FIG. 15 is a view according to section plane XV-XV of FIG. 13.

With reference to the appended tables of drawings, reference numeral (1) denotes in its entirety a rear portion of the ski mountaineering binding according to the invention, comprising:

a base (2) to be fixed to a ski (not illustrated);

a turret (3) which is borne by the base (2) and which is rotatable with respect to the base (2) in order to assume a first position of the turret (3A) (FIGS. 1-8 and 29-32), wherein it is hookable to the heel (4) of a ski boot (illustrated in FIGS. 5, 8, 29, 32), so that it is easy to ski downhill, and in order to assume a second position of the turret (3B) (FIGS. 9-24 and 33-36), wherein it is not hookable to the heel (4) of a ski boot, so that it is easy to walk uphill;

a brake (5) for a ski which is fixable to the ski and which is able to assume a braked configuration (5A) (FIGS. 1-4, 9-12, 25-28), in which it brakes the ski, and a non-active configuration (5B) (FIGS. 5-8, 21-24, 29-36) in which the brake (5) is non-active;

first elastic means which are arranged so as to exert a force which tends to bring the brake (5) into the braked configuration (5A);

a cam (6) which is borne by the turret (3) and which is arranged in such a way as to assume a first position of the cam (6A), when the turret (3) is in the first position of the turret (3A), and to assume the second position of the cam (6B) when the turret (3) is in the second position of the turret (3B);

a pusher (7) which is borne by the base (2), which is movable along a second movement path (70) and which is activatable by the cam (6) in order to assume a first position of the pusher (7A), when the cam (6) is in the first position of the cam (6A), and in order to assume a second position of the pusher (7B), when the cam (6) is in the second position of the cam (6B);

a hooking member (8) which:

is borne by the base (2);

comprises a hook (81) for hooking the brake (5);

is movable along a first movement path (80) which is transversal to the axis of the ski, when the base (2) is fixed to the ski;

and is activatable to assume a disengaged configuration (8A) (FIGS. 1-8, 25-28, 29-32), wherein the hook (81) is not able to hook the brake (5), and to assume an engaged configuration (8B) (FIGS. 9-24, 33-36), wherein the hook (81) is able to hook the brake (5) when the brake (5) is brought into the non-active configuration (5B), maintaining the brake (5) stably in the non-active configuration (5B);

comprises an abutment (82) for abutting the pusher (7);

and is activatable by the turret (3), via the cam (6) and the pusher (7), to assume the disengaged configuration (8A) when the turret (3) is in the first position of the turret (3A) and to assume the engaged configuration (8B) when the turret (3) is in the second position of the turret (3B);

second elastic means (9) acting on the hooking member (8), in order to exert a force which tends to push the hooking member (8) into the engaged configuration (8B).

The base (2) can comprise a lower portion (21) which is provided with four through-holes (23)(see for example FIG.

3) in order to be fixed by means of screws (not illustrated) to a ski (not illustrated), and an upper portion (22) which is constrained to the lower portion (21) and which bears the turret (3), the cam (6), the pusher (7) and the hooking member (8). For example, the upper portion (22) can slide with respect to the lower portion (21) along the axis of the ski. The rear portion of the ski mountaineering binding (1) can comprise first adjustment means (24), of known type, which enable adjusting the position of the upper portion (22) of the base (2) with respect to the lower portion (21) of the base (2).

The turret (3) is preferably rotatably coupled with respect to the base (2). Still more preferably, the turret (3) is rotatably coupled to the base (2).

The rear portion of a ski mountaineering binding (1) can comprise two pins (31). The pins (31) can be borne by the turret (3) to hook the turret (3) to the heel (4) of a ski boot for downhill skiing, see FIGS. 5, 8, 29, 32.

The rear portion of the ski mountaineering binding (1) can comprise one or more heel lifters (32)(in the figures two heel lifters (32) are illustrated). Each heel lifter (32) can be borne by the turret (3) to rotate between an active position (not illustrated in the drawings), wherein it offers a support for the heel (4) of a ski boot for uphill walking, and a non-active position (illustrated in the drawings).

In the first position of the turret (3A), the pins (31) are preferably facing towards the front part of the ski. Further, the pins (31) can be orientated parallel to the axis of the ski.

In the second position of the turret (3B), the pins (31) are preferably facing towards the rear part of the ski. Further, the pins (31) can be orientated parallel to the axis of the ski.

The first position of the turret (3A) and the second position of the turret (3B) are preferably moved away by an angle of 180 degrees.

The rear portion of the ski mountaineering binding (1) can comprise second regulating means (33), of known type, to stabilise the first position of the turret (3A) and the second position of the turret (3B), so that passing from the first position of the turret (3A) to the second position of the turret (3B), or vice versa, requires application of at least a predetermined rotation torque to the turret (3).

The first elastic means can be integrated in the brake (5) and for example not be visible, as in the case illustrated in the figures (in fact no numerical reference has been associated to them). Alternatively, the first elastic means can comprise one or more torque springs anchored to the base (2) (solution not illustrated).

In the disengaged configuration (8A) of the hooking member (8) the hook (81) is preferably moved away from the brake (5) and thus cannot hook the brake (5).

The second elastic means (9) preferably act in opposition to the action exerted by the pusher (7) on the hooking member (8), when the turret (3) is in the first position of the turret (3A), and opposite the action exerted by the brake (5), when the turret (3) is in the second position of the turret (3B) and the brake (5) is in the non-active configuration (5B).

The cam (6) is preferably fixed to the turret (3). In the illustrated figures (for example FIG. 3) three fastening screws of the cam (6) to the turret (3) can be seen; this is only one example of fastening.

The cam (6) can have an oval shape (the first embodiment, illustrated in FIGS. 1-28) or another shape (in the second embodiment, illustrated in FIGS. 29-36 the shape is like an earlobe).

The cam (6) can be arranged at the lower end of the turret (3).

The rear portion of a ski mountaineering binding (1) preferably comprises: a first seat (83) for slidably receiving the hooking member (8) along the first movement path (80); a second seat (71) for slidably receiving the pusher (7) along the second movement path (70); and a third seat (61) for rotatably receiving the cam (6). Further: the first seat (83) opens into the second seat (71); the second seat (71) opens into the third seat (61); the pusher (7) is dimensioned in such a way as to enter the first seat (83) with a relative first end (72) when it is in the first position of the pusher (7A), and in such a way as to enter the third seat (61) with a relative second end (73) when it is in the second position of the pusher (7B).

Preferably, the second seat (71) has a channel shape in order for the pusher (7) to translate along it; the abutment (82) of the hooking member (8) is provided with a first abutment plane (82); the pusher (7) comprises a second abutment plane (74) which is parallel to the first abutment plane (82) in order to abut the first abutment plane (82) and slide with respect thereto. This enables minimising the friction between the pusher (7) and the hooking member (8). See for example FIG. 3. According to a first embodiment, the first abutment plane (82) and the second abutment plane (74) are perpendicular to the axis of the ski, while according to a second embodiment, they are inclined by about 45 degrees with respect to the axis of the ski.

The hooking member (8) and/or the pusher (7) and/or the cam (6) can be made of a self-lubricating material For example, acetal resin).

The first seat (83) preferably forms a first recess (84) arranged on an opposite side with respect to the second seat (71); the pusher (7) is dimensioned so that in the first position of the pusher (7A) the relative first end (72) of the pusher (7) at least partially occupies the first recess (84). See for example FIG. 3.

The pusher (7) is preferably arranged to slide below the hooking member (8). Still more preferably, the pusher (7) is arranged to slide between the base (2) and hooking member (8).

The hooking member (8) preferably comprises a second recess (85) through which the first pusher (7) is slidable; a part of the second recess (85) forms the abutment (82).

The second recess (85) is preferably facing the base (2).

The second elastic means (9) are preferably housed in the first seat (83). See for example FIG. 2.

The second elastic means (9) can be a spring.

The first seat (83), the second seat (the second seat (71) and the third seat (61) are preferably fashioned in the base (2).

The third seat (61) can have a circular shape.

The third seat (61) can be a circular hole fashioned in the base (2).

The first seat (83) is preferably perpendicular to the axis of the ski when the base (2) is fixed to the ski.

The second seat (71) can be transversal to the axis of the ski when the base (2) is fixed to the ski, for example inclined by about 45 degrees (see the first embodiment), or be parallel to the axis of the ski when the base (2) is fixed to the ski (see the second embodiment), so that the pusher (7) moves parallel to the axis of the ski.

The brake (5) preferably comprises: a first brake arm (51) which is movable to project beneath the rest surface of the ski to drag on the layer of snow covering the terrain and thus brake the ski, when the base (2) is fixed to the ski and the brake (5) is in the braked configuration (5A) (see for example FIGS. 1-4), and to be above the rest surface of the ski when the base (2) is fixed to the ski and the brake (5) is in the non-active configuration (5B) (see for example FIGS. 5-8); and an activating lever (53) for activating the first brake arm (51), which is connected to the first brake arm (51) and which is arranged so as to be pressed by the heel (4) of a ski boot (see FIGS. 5, 8, 29, 32), when the heel (4) of a ski boot hooks to the turret (3), in order to bring the brake (5) into the non-active configuration (5B) in an opposing position with respect to the action exerted by the first elastic means see FIGS. 5-8, 29-32).

Figure 14:
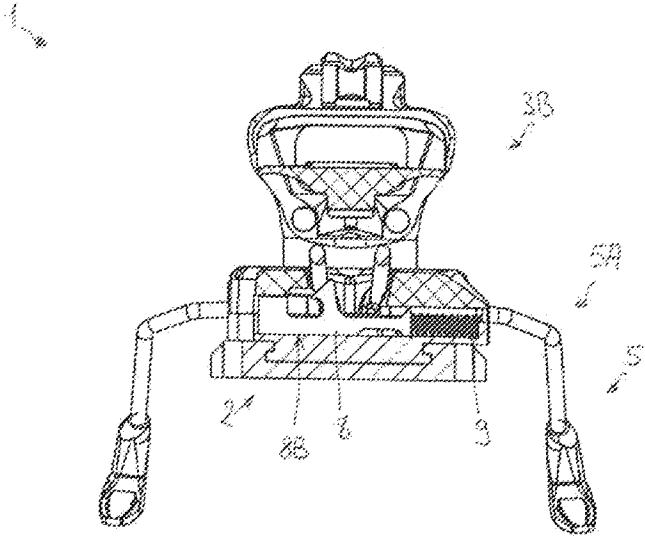
FIG. 14 is a view according to section plane XIV-XIV of FIG. 13.
Figure 16:
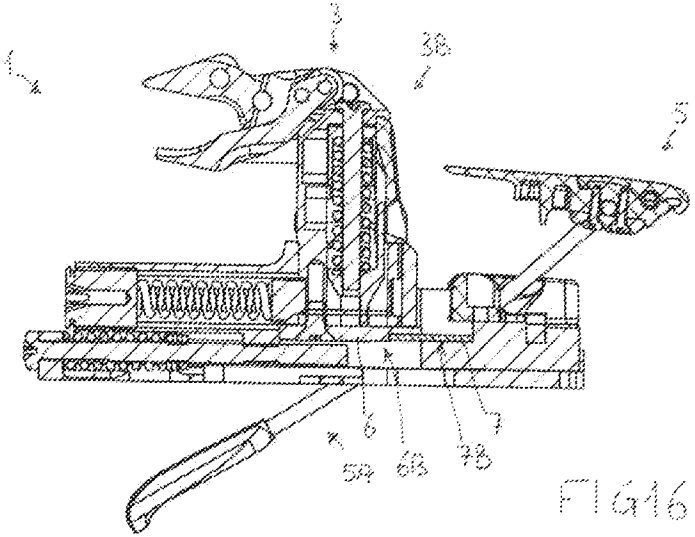
FIG. 16 is a view according to section plane XVI-XVI of FIG. 15.
Figure 17:
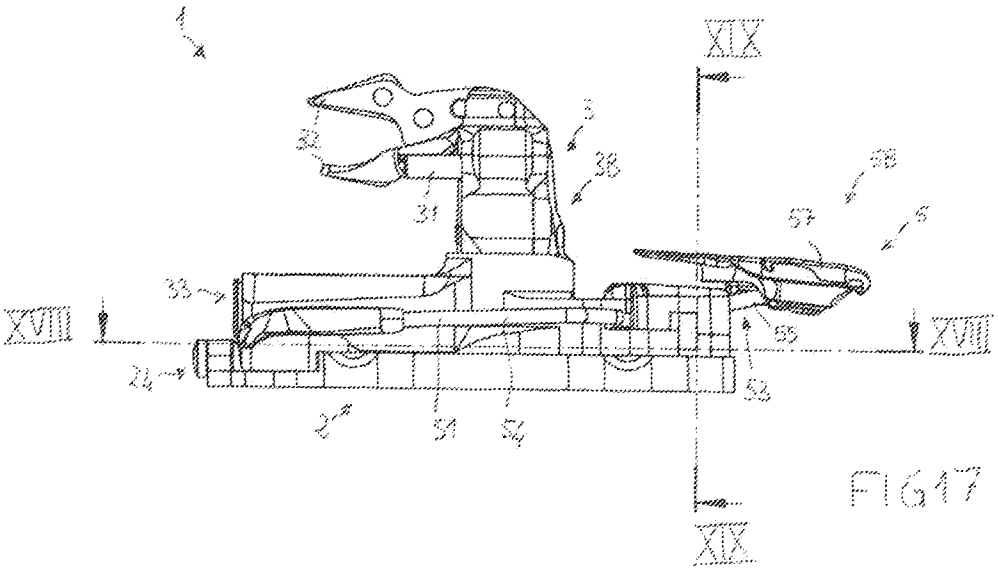
FIG. 17 is a lateral view of the rear portion of the ski mountaineering binding of FIG. 1, in a configuration successive to the one shown in FIG. 13, in which the turret is in the second position of the turret for walking uphill and the brake is moving towards the non-active configuration.
Figure 19:
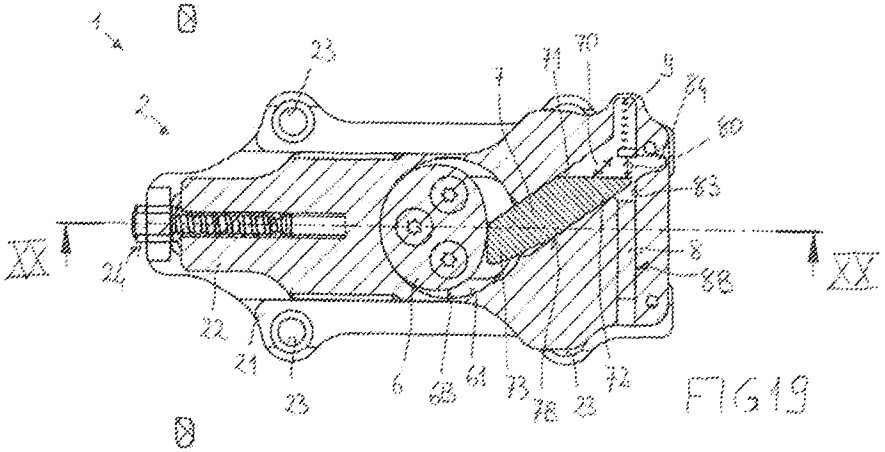
FIG. 19 is a view according to section plane XIX-XIX of FIG. 17.
Figure 18:
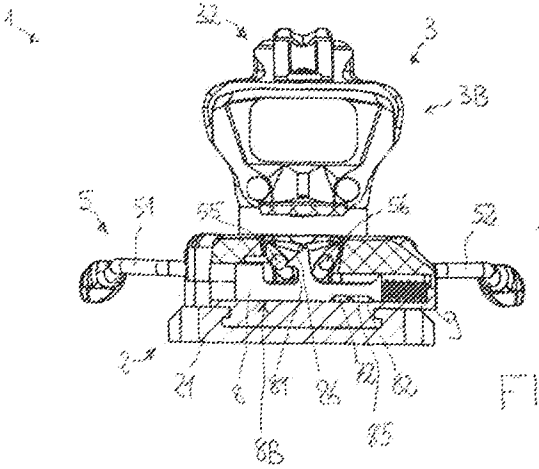
FIG. 18 is a view according to section plane XVIII-XVIII of FIG. 17.
Figure 20:
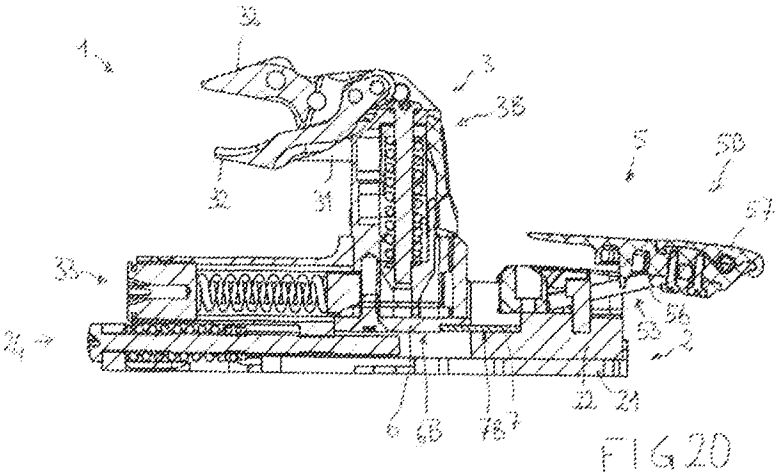
FIG. 20 is a view according to section plane XX-XX of FIG. 19.
Figure 21:
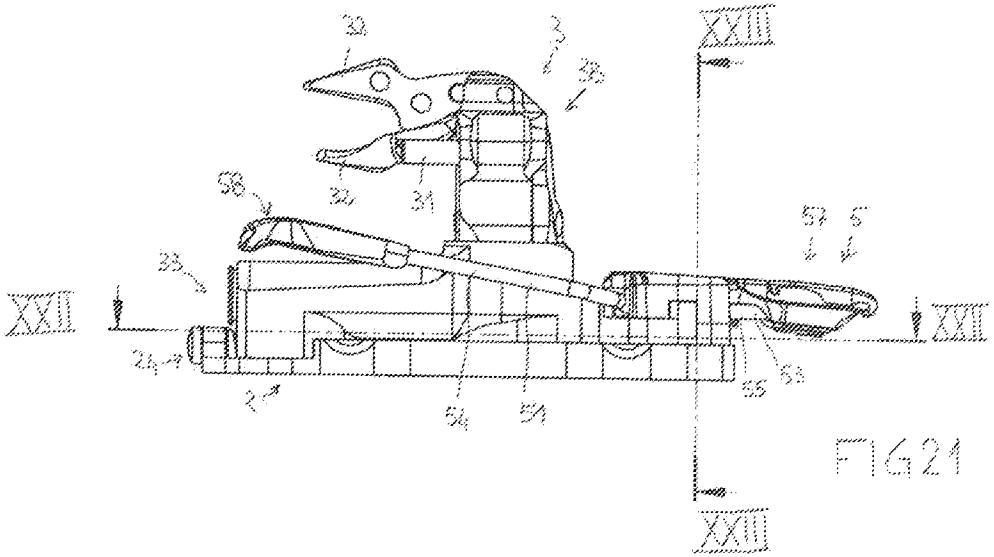
FIG. 21 is a lateral view of the rear portion of the ski mountaineering binding of FIG. 1, in a configuration successive to the one shown in FIG. 17, in which the turret is in the second position of the turret for walking uphill and the brake is in the non-active configuration; the user can thus walk uphill.
Figure 23:
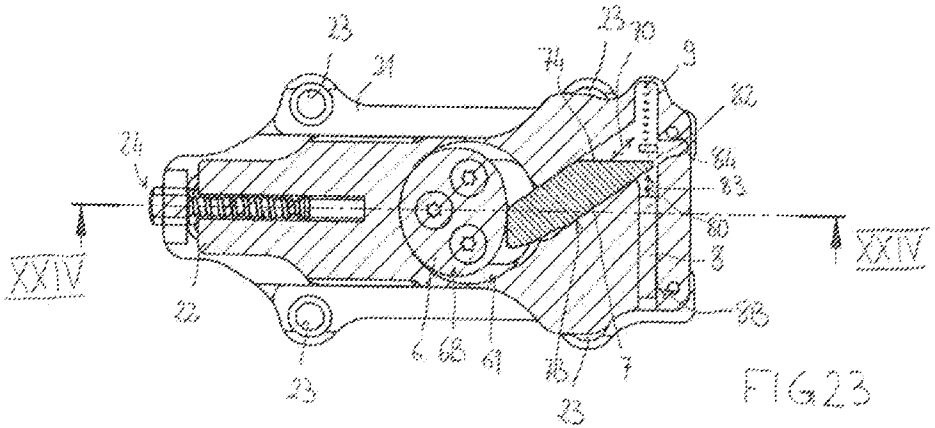
FIG. 23 is a view according to section plane XXIII-XXIII of FIG. 21.
Figure 22:
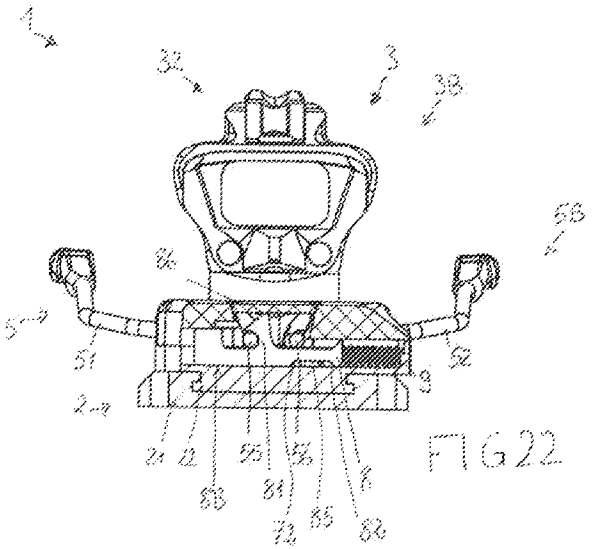
FIG. 22 is a view according to section plane XXII-XXII of FIG. 21.
Figure 24:
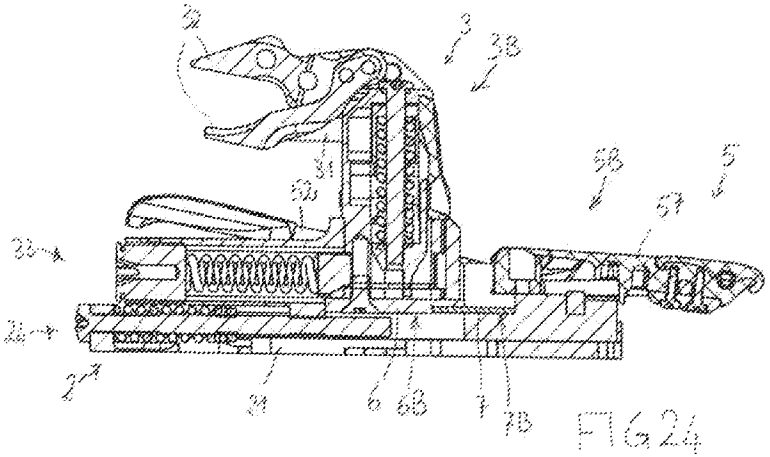
FIG. 24 is a view according to section plane XXIV-XXIV of FIG. 23.
Figure 25:
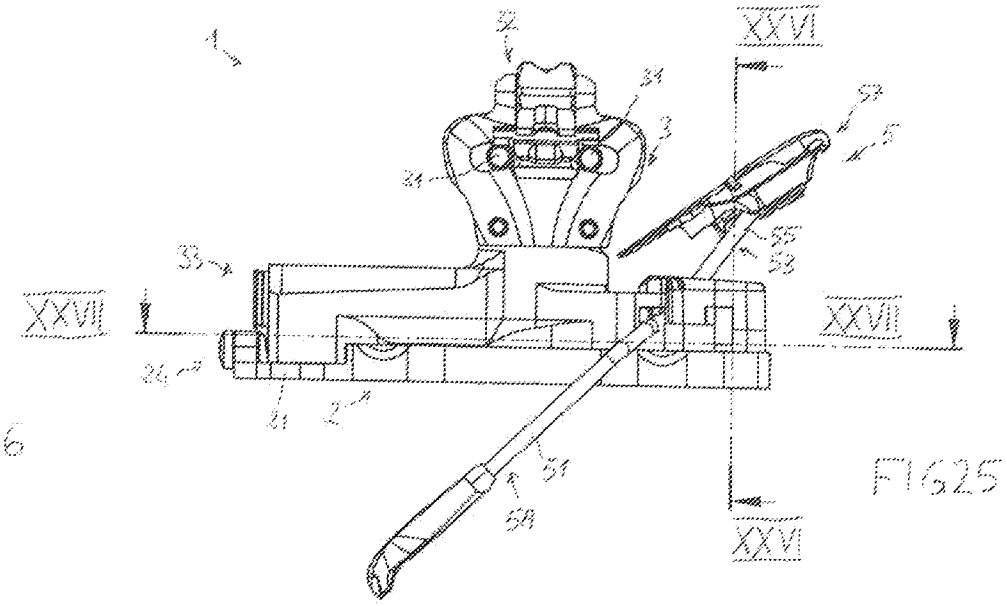
FIG. 25 is a lateral view of the rear portion of the ski mountaineering binding of FIG. 1, in a configuration successive to the one shown in FIG. 21, in which the turret is newly moving into the first position of the turret so that the brake has been disengaged from the hooking member and is now in the braked configuration.
Figure 27:
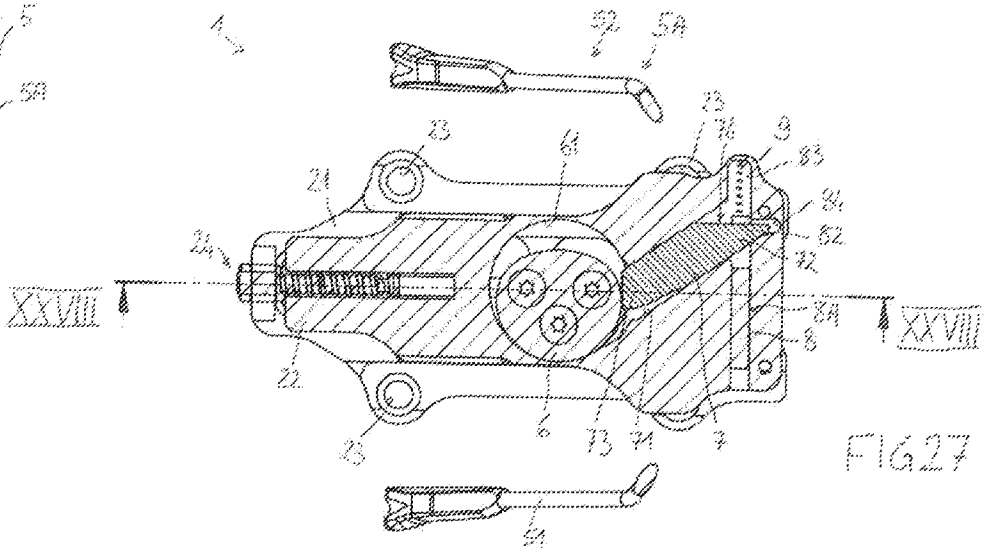
FIG. 27 is a view according to section plane XXVII-XXVII of FIG. 25.
Figure 26:
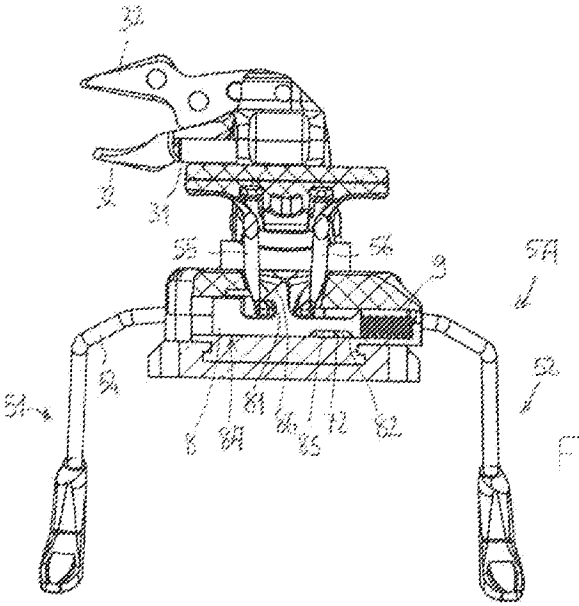
FIG. 26 is a view according to section plane XXVI-XXVI of FIG. 25.
Figure 28:
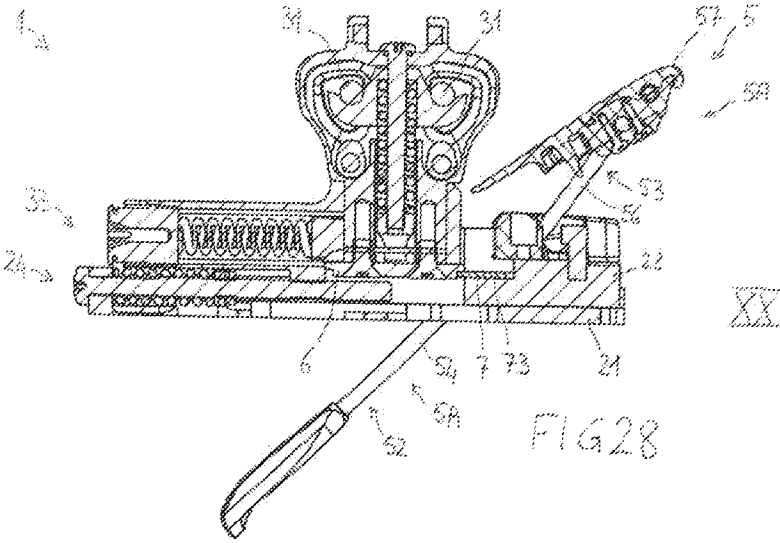
FIG. 28 is a view according to section plane XXVIII-XXVIII of FIG. 27.
Figure 29:
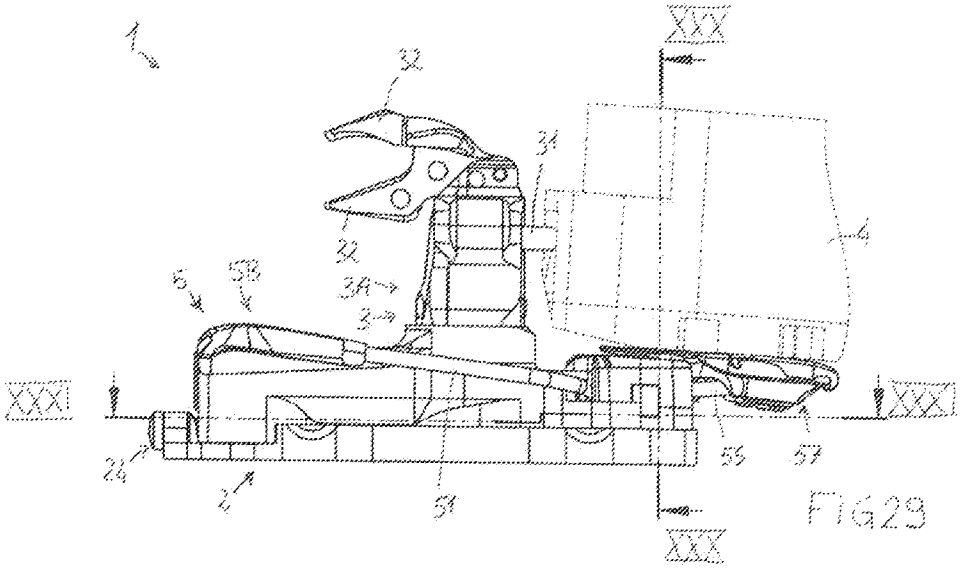
FIG. 29 is a lateral view of the rear portion of the ski mountaineering binding according to a second embodiment of the invention, in which the shape of the cam of the pusher and the hooking member changes, in a configuration alike to that of FIG. 5, which enables a user to ski downhill.
Figure 31:
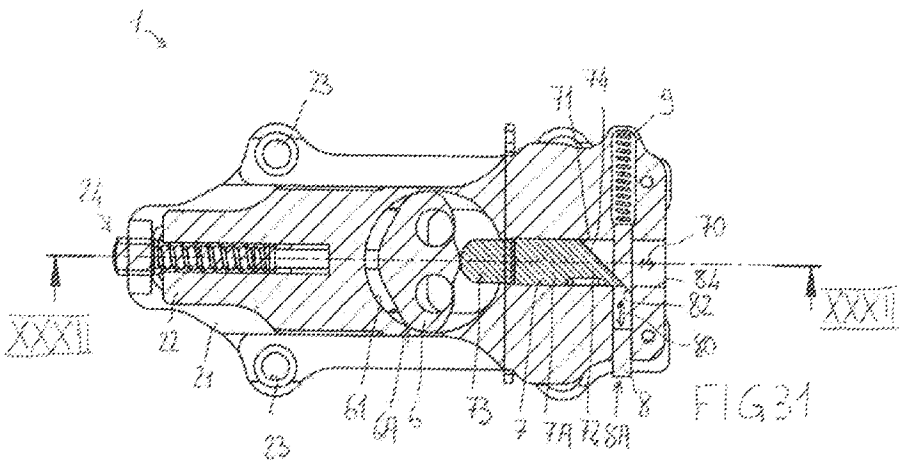
FIG. 31 is a view according to section plane XXXI-XXXI of FIG. 29.
Figure 30:
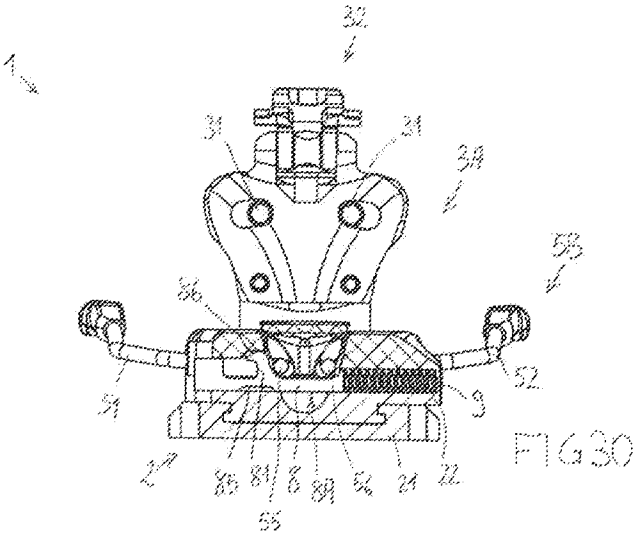
FIG. 30 is a view according to section plane XXX-XXX of FIG. 29.
Figure 32:
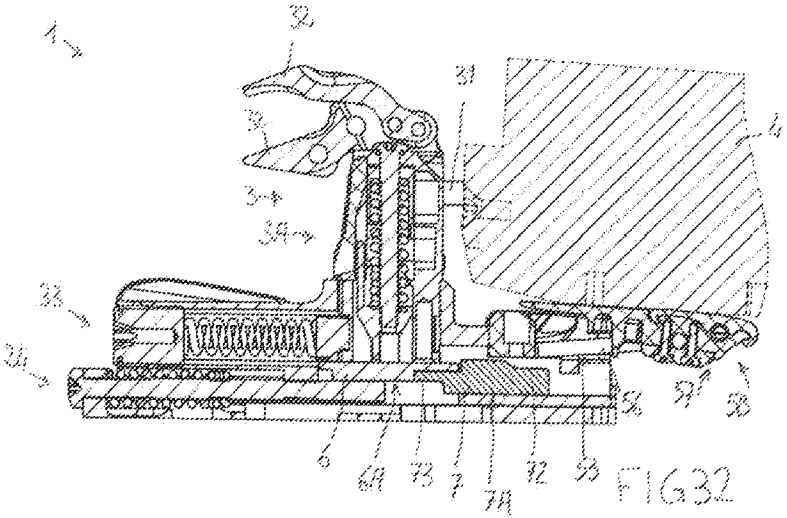
FIG. 32 is a view according to section plane XXXII-XXXII of FIG. 31.
Figure 33:
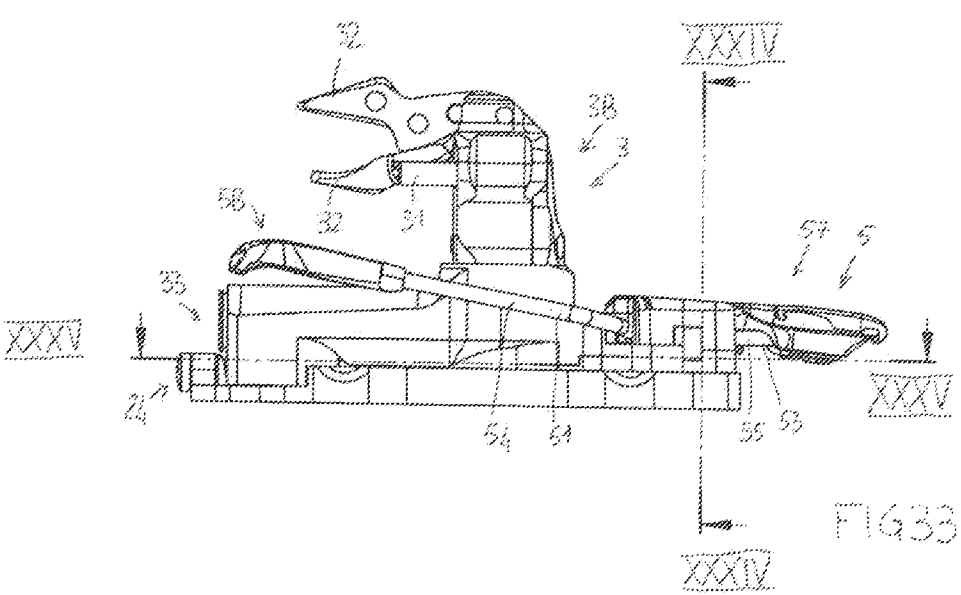
FIG. 33 is a lateral view of the rear portion of the ski mountaineering binding of FIG. 29, in a configuration alike to that of FIG. 21, which enables a user to ski uphill.
Figure 34:
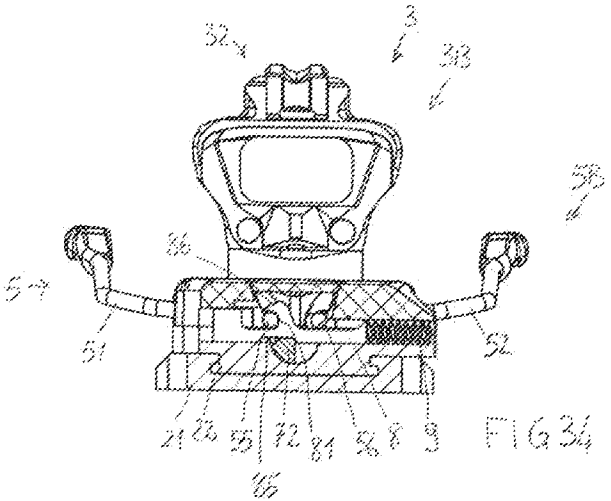
FIG. 34 is a view according to section plane XXXIV-XXXIV of FIG. 33.
Figure 35:
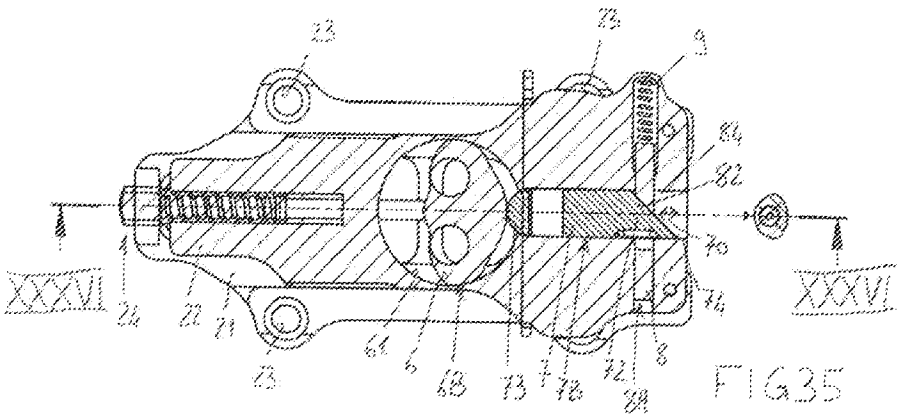
FIG. 35 is a view according to section plane XXXV-XXXV of FIG. 33.
Figure 36:
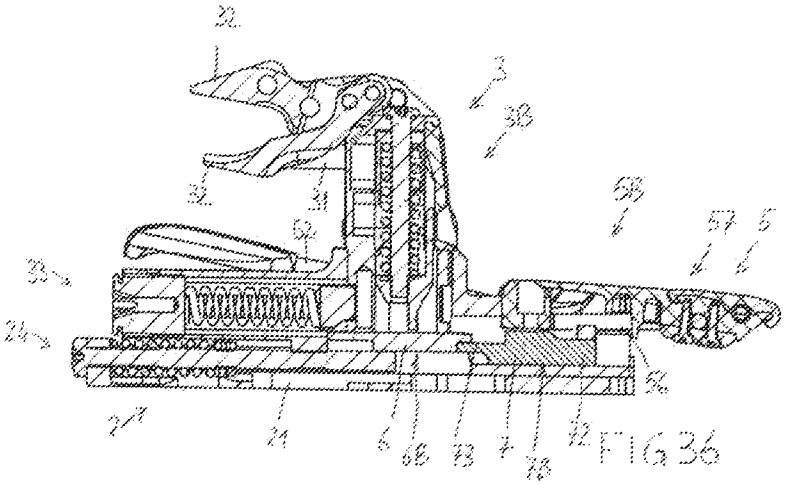
FIG. 36 is a view according to section plane XXXVI-XXXVI of FIG. 35.

The brake (5) preferably comprises a wire element (54); the hook (81) is surmounted by an inclined plane (86) for abutting the wire element (54) and to cause the hooking member (8) to temporarily recede when the brake (5) is reaching the non-active configuration (5B) (compare FIGS. 14, 18, 22 to one another).

The brake (5) is preferably borne by the base (2) (as illustrated in the drawings). Alternatively (not illustrated), the brake (5) is fixed directly to the ski.

The brake (5) can comprise a wire element (54) (as already specified in the foregoing and illustrated in the drawings) or a plurality of wire elements.

The wire element (54) can be a metal spindle, appropriately bent.

The brake (5) can comprise a fork which in turn comprises the first brake arm (51) and a second brake arm (52). The first brake arm (51) and the second brake arm (52) are moved away from one another by a distance that is greater than the width of the ski, so that in the braked configuration (5A) the arms can intercept the snow on both sides of the ski and so that in the non-active configuration (5B) they are raised, as already specified in the foregoing. The central part of the fork can be coupled, preferably rotatably, to the rear portion of a ski mountaineering binding (1), preferably at the base (2), or to the ski (according to the variant that is not illustrated). The brake (5) can further comprise a first prong (55) and a second prong (56) which, on one side, are connected to the central part of the fork, and extend, staying reciprocally parallel and away from one another. The first prong (55) and the second prong (56) can be part of the activating lever (53) of the brake (5). The distance between the first prong (55) and the second prong (56) is preferably less than the distance between the first brake arm (51) and the second brake arm (52), measured perpendicularly to the axis of the ski. The brake (5) can be in a single body, and in that case the first prong (55) and the second prong (56) are connected to one another. The brake (5) preferably comprises a plate (57) to abut the sole of the heel (4) of a ski boot (see for example FIG. 5). The plate (57) can be connected to an end of the activating lever (53), for example rotatably. The plate (57) can be connected to the first prong (55) and the second prong (56).

There follows a description of the operation of the first embodiment of the rear portion of a ski mountaineering binding (1).

According to FIGS. 1-4, the turret (3) is in the first position of the turret (3A), so that it is hookable to the heel (4) of a ski boot, the cam (6) is in the first position of the cam (6A), the pusher (7) is in the first position of the pusher (7A) and the hooking member (8) is in the disengaged configuration (8A). The brake (5) is in the braked configuration (5A). The hooking member (8) is in the disengaged configuration (8A). Notwithstanding the action of the second elastic means (9), the hooking member (8) cannot reach the engaged configuration (8B) due to the presence of the first pusher (7) which abuts the abutment (82) of the hooking member (8); see FIG. 3.

Thereafter, see FIGS. 5-8, a heel (4) of a ski boot has been hooked to the turret (3) and presses on the plate (57) of the brake (5), which has caused the raising of the first brake arm (51) and the second brake arm (52) via the activating lever (53), so that the brake (5) has reached the non-active configuration (5B). The hooking member (8) remains in the disengaged configuration (8A): note, in this matter (FIG. 6), the distance between the hook (81) and the first brake arm (51), which clarifies how the hook (81) cannot hook the brake (5). At this point the skier can ski downhill.

Subsequently, FIGS. 9-12, the turret (3) is rotated to assume the second position of the turret (3B) when the cam (6) assumes the second position of the cam (6B), freeing a space in the third seat (61). This space is occupied by the pusher (7) via the relative second end (73). The pusher (7) thus reaches the second position of the pusher (7B) due to the hooking member (8), which in turn is activated by the second elastic means (9). The hooking member (8) thus reaches the engaged configuration (8B), which enables the hook (81) to hook the brake (5), as will be clarified in the following.

Alternatively to the embodiments illustrated in the figures, which show the pusher (7) free to slide in the second seat (71), the pusher (7) might be connected mechanically to the cam (6), for example by means of an articulated arm, which is not illustrated, so that the cam (6) draws with it the pusher (7) in moving from the first position of the turret (3A) to the second position of the turret (3B).

Thereafter, FIGS. 13-16 show that the plate (57) has been lowered towards the base (2), while FIGS. 17-20 show that the plate (57) has been further lowered towards the base (2). In particular, compare FIGS. 14 and 18, in which it can be observed that the first brake arm (51) has slid on the inclined plane (86), determining a retraction of the hooking member (8) so that the abutment (82) of the hooking member (8) has lost contact with the pusher (7).

Thereafter, see FIGS. 21-24, the first brake arm (51) enters the loop formed by the hook (81) and the hooking member (8) newly advances, though only slightly, to realise the hooking (81) of the hook (81) with the first brake arm (51), so that the brake (5) is stably maintained in the non-active configuration (5B). However, the hooking member (8) still occupies a position in which the abutment (82) does not contact the pusher (7) (see FIG. 23). At this point the skier can walk uphill, with the ability to rotate one of the two heel lifters into the relative active position (as mentioned, not illustrated) so that the heel of the ski boot has a support at a greater height.

Lastly, in order to return to ski downhill it is sufficient simply to rotate the turret (3) so that it newly reaches the first position of the turret (3A), with the consequence that the pusher (7) advances along the second seat (71) newly intercepting the abutment (82) of the hooking member (8) and causing the hooking member (8) to retract, compressing the second elastic means (9). In this way, the hook (81) retracts, freeing the first brake arm (51) and thus enabling the brake (5) to return into the braked configuration due to the action of the first elastic means.

FIGS. 25-28 illustrate an intermediate position of the turret (3), before reaching the first position of the turret (3A), in which the turret (3) has rotated by only 90 degrees instead of 180 degrees. This has however been sufficient for the hook (81) to free the first brake arm (51).

The second embodiment, illustrated in FIGS. 29-36, differs: due to the different shape of the cam (6), of the pusher (7) and of the hooking member (8); and due to the fact that the second seat (71) is parallel to the axis of the ski when the base (2) is fixed to the ski. In this case, the first abutment plane (82) and the second abutment plane (74) are inclined with respect to the axis of the ski.

It is understood that the foregoing has been described by way of non-limiting example, so that any constructional variants are to be taken to fall within the protective scope of the present technical solution, as disclosed herein.

The invention claimed is:

1. A rear portion of a ski mountaineering binding, comprising:

a base in order to be fixed to a ski;

a turret which is borne by the base and which is rotatable with respect to the base in order to assume a first position of the turret, wherein the rear portion of the ski mountaineering binding is hookable to a heel of a ski boot, to facilitate skiing downhill, and in order to assume a second position of the turret, wherein the rear portion of the ski mountaineering binding is not hookable to the heel of the ski boot, to facilitate walking uphill;

a brake for a ski which is fixable to the ski and which is able to assume a braking configuration, to brake the ski, and a non-active configuration wherein the brake is non-active;

first elastic means which are arranged to exert a force which tends to bring the brake into the braking configuration; and a hooking member which:

is borne by the base;

comprises a hook for hooking the brake;

is movable along a first movement path which is transversal to the axis of the ski, when the base is fixed to the ski; and is activatable to assume a disengaged configuration, wherein the hook is not able to hook the brake, and to assume an engaged configuration, wherein the hook is able to hook the brake when the brake is brought into the non-active configuration, maintaining the brake stably in the non-active configuration;

further comprising:

second elastic means acting on the hooking member, in order to exert a force which tends to push the hooking member into the engaged configuration;

a cam which is borne by the turret and which is arranged in order to assume a first position of the cam, when the turret is in the first position of the turret, and in order to assume a second position of the cam, when the turret is in the second position of the turret; and a pusher which is borne by the base, which is movable along a second movement path and which is activatable by the cam in order to assume a first position of the pusher, when the cam is in the first position of the cam, and in order to assume a second position of the pusher, when the cam is in the second position of the cam, wherein the hooking member comprises an abutment for abutting the pusher, and is activatable by the turret, via the cam and the pusher, to assume the disengaged configuration when the turret is in the first position of the turret and to assume the engaged configuration when the turret is in the second position of the turret.

2. The rear portion of a ski mountaineering binding of claim 1, further comprising:

a first seat for slidably receiving the hooking member along the first movement path;

a second seat for slidably receiving the pusher along the second movement path; and a third seat for rotatably receiving the cam;

wherein:

the first seat opens into the second seat;

the second seat opens into the third seat; and the pusher is dimensioned in such a way as to enter the first seat with a relative first end when it is in the first position of the pusher, and in such a way as to enter the third seat with a relative second end when it is in the second position of the pusher.

3. The rear portion of a ski mountaineering binding of claim 2, wherein:

the second seat has a channel shape in order for the pusher to translate along the second seat;

the abutment of the hooking member is provided with a first abutment plane; and the pusher comprises a second abutting plane which is parallel to the first abutment plane in order to abut the first abutment plane and slide with respect thereto.

4. The rear portion of a ski mountaineering binding of claim 2, wherein:

the first seat comprises a first recess arranged on an opposite side with respect to the second seat; and the pusher is dimensioned in such a way that in the first position of the pusher the relative first end of the pusher at least partially occupies the first recess.

5. The rear portion of a ski mountaineering binding of claim 2, wherein the pusher is arranged to slide below the hooking member.

6. The rear portion of a ski mountaineering binding of claim 5, wherein:

the hooking member comprises a second recess through which the first pusher is slidable; and a part of the second recess forms the abutment.

7. The rear portion of a ski mountaineering binding of claim 2, wherein the second elastic means are housed in the first seat.

8. The rear portion of a ski mountaineering binding of claim 2, wherein the first seat, the second seat and the third seat are made in the base.

9. The rear portion of a ski mountaineering binding of claim 2, wherein the first seat is perpendicular to the axis of the ski when the base is fixed to the ski.

10. The rear portion of a ski mountaineering binding of claim 1, wherein:

the brake comprises a wire element; and the hook is surmounted by an inclined plane for abutting the wire element and for causing the hooking member to temporarily recede when the brake is reaching the non-active configuration.

11. The rear portion of a ski mountaineering binding of claim 1, wherein the brake comprises:

a first brake arm which is movable to project beneath the rest surface of the ski to drag on the layer of snow covering the terrain and thus brake the ski, when the base is fixed to the ski and the brake is in the braking configuration, and to be above the rest surface of the ski when the base is fixed to the ski and the brake is in the non-active configuration; and an activating lever for activating the first brake arm, which is connected to the first brake arm and which is arranged so as to be pressed by a heel of a ski boot, when the heel of a ski boot hooks to the turret, in order to bring the brake into the non-active configuration in an opposing position with respect to the action exerted by the first elastic means.

* * * * *